US007270388B2

(12) United States Patent
Mitsuzawa et al.

(10) Patent No.: US 7,270,388 B2
(45) Date of Patent: Sep. 18, 2007

(54) PRINTING APPARATUS, COMPUTER-READABLE STORAGE MEDIUM, COMPUTER SYSTEM, PRINTING METHOD, AND METHOD FOR MANUFACTURING PRINTED ARTICLE

(75) Inventors: Toyohiko Mitsuzawa, Nagano-ken (JP); Toshihisa Saruta, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 289 days.

(21) Appl. No.: 10/725,348

(22) Filed: Dec. 2, 2003

(65) Prior Publication Data

US 2004/0155924 A1 Aug. 12, 2004

(30) Foreign Application Priority Data

Dec. 2, 2002 (JP) ..... 2002-350404
Nov. 25, 2003 (JP) ..... 2003-393635

(51) Int. Cl.
*B41J 29/38* (2006.01)

(52) U.S. Cl. ..... 347/9; 347/10; 347/11; 347/15

(58) Field of Classification Search ..... 347/9, 347/10, 11, 15
See application file for complete search history.

(56) References Cited

U.S. PATENT DOCUMENTS 6,439,683 B1 * 8/2002 Matsumoto et al. ..... 347/15
6,488,354 B2 * 12/2002 Hosono ..... 347/23
6,764,158 B2 * 7/2004 Arquilevich et al. ..... 347/19
2002/0008731 A1 * 1/2002 Matsumoto et al. ..... 347/42
2002/0060706 A1 * 5/2002 Sawano ..... 347/15

FOREIGN PATENT DOCUMENTS

JP 9-164706 6/1997

* cited by examiner

*Primary Examiner*—Manish S. Shah
*Assistant Examiner*—Laura E. Martin
(74) *Attorney, Agent, or Firm*—Sughrue Mion, PLLC

(57) ABSTRACT

A printing apparatus includes a plurality of ink ejecting sections for ejecting ink. The printing apparatus prints an image on a medium to be printed by ejecting ink from the ink ejecting sections. The ink ejecting sections include a first ink ejecting section that is set to eject ink for printing a highlight region in the image, and a second ink ejecting section that is set not to eject the ink for printing the highlight region in the image.

16 Claims, 10 Drawing Sheets

PRINTING APPARATUS, COMPUTER-READABLE STORAGE MEDIUM, COMPUTER SYSTEM, PRINTING METHOD, AND METHOD FOR MANUFACTURING PRINTED ARTICLE

CROSS-REFERENCE TO RELATED APPLICATIONS

The present application claims priority upon Japanese Patent Application No. 2002-350404 filed Dec. 2, 2002 and Japanese Patent Application No. 2003-393635 filed Nov. 25, 2003, the contents of which are herein incorporated by reference.

BACKGROUND OF THE INVENTION

1. Field of the Invention

The present invention relates to printing apparatuses that print images by ejecting ink from a plurality of ink ejecting sections to form dots on a medium to be printed, computer-readable storage media having recorded thereon a program for printing with such printing apparatuses, computer systems including such printing apparatuses, methods for printing with such printing apparatuses, and methods for manufacturing printed articles with such printing apparatuses.

2. Description of the Related Art

Inkjet printers that have print heads arranged in opposition to a medium to be printed, such as print paper, and that form dots on the print paper by ejecting ink onto the paper from ink ejecting sections provided on these print heads are known as a type of printing apparatus that prints images on the medium to be printed by ejecting ink from a plurality of ink ejecting sections. (Refer to, for example, Japanese Patent Application Laid-open Publication No. 9-164706.) Such inkjet printers are also capable of printing gradated images using different-sized dots.

However, if the dots are not precisely formed in their target positions when printing gradated images, and particularly the highlight regions (the whitish areas with sparse dots) in the images, images with greater granularity, that is, so-called grainy images will be printed. Therefore, it is necessary that dots, particularly those formed in highlight regions, are printed precisely in their target positions.

SUMMARY OF THE INVENTION

The present invention has been made in view of such problems, and an object thereof is to provide a printing apparatus capable of particularly precisely printing dots that are formed in the highlight regions in images, a computer-readable storage medium having recorded thereon a program for printing with the printing apparatus, a computer system having the printing apparatus, a method for printing with the printing apparatus, and a method for manufacturing printed articles with the printing apparatus.

An aspect of the present invention is a printing apparatus comprising a plurality of ink ejecting sections for ejecting ink. The printing apparatus prints an image on a medium to be printed by ejecting ink from the ink ejecting sections. The ink ejecting sections include a first ink ejecting section that is set to eject ink for printing a highlight region in the image, and a second ink ejecting section that is set not to eject the ink for printing the highlight region in the image.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
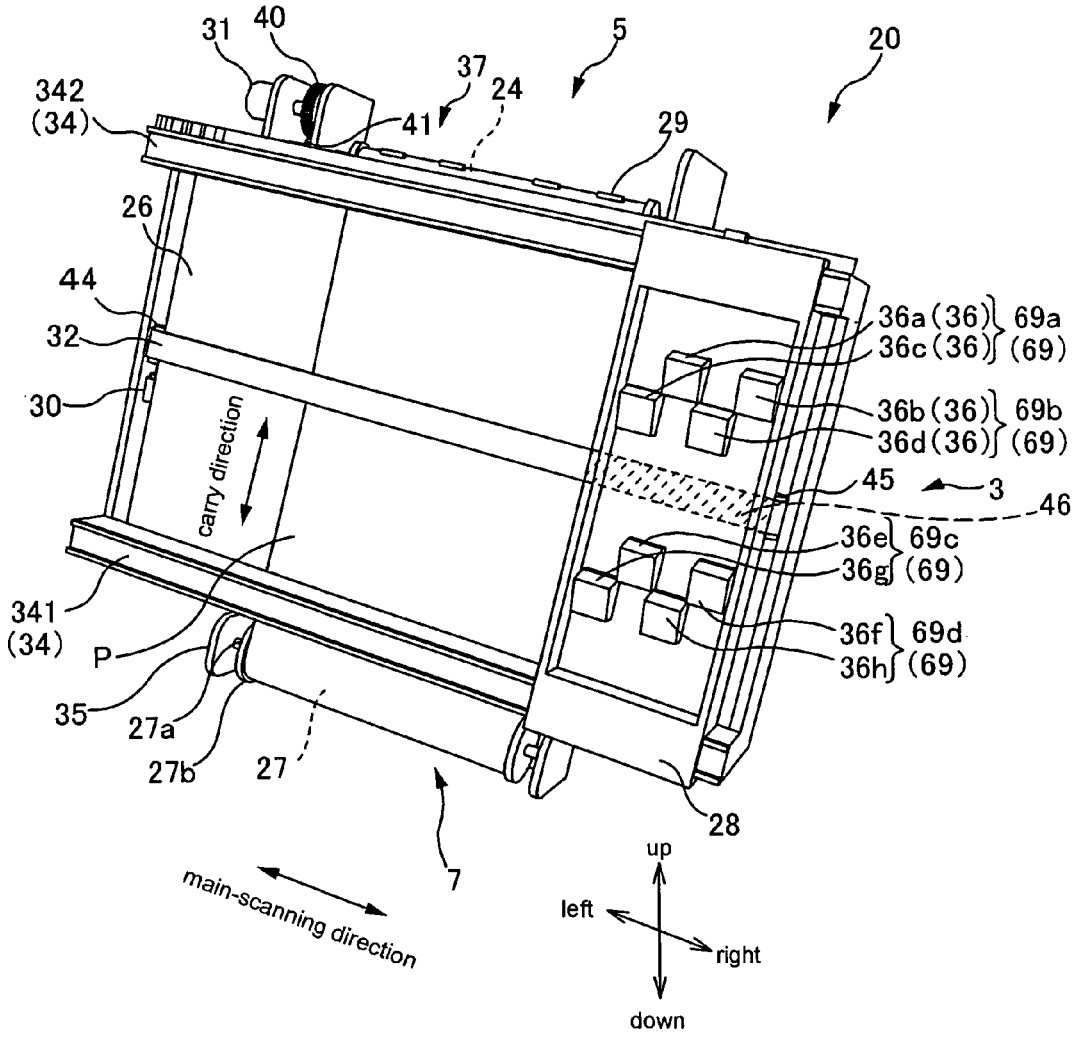
FIG. 1 is a perspective view showing an overview of a color printer according to a first embodiment of the present invention.

At least the following matters will be made clear by the explanation in the present specification and the description of the accompanying drawings.

An aspect of the present invention is a printing apparatus comprising: a plurality of ink ejecting sections for ejecting ink, wherein the printing apparatus prints an image on a medium to be printed by ejecting ink from the ink ejecting sections; and wherein the ink ejecting sections include a first ink ejecting section that is set to eject ink for printing a highlight region in the image, and a second ink ejecting section that is set not to eject the ink for printing the highlight region in the image.

According to such a printing apparatus, the precision in the positions where dots are formed for each ink ejecting section differs due to various factors. However, by setting some of those ink ejecting sections as ink ejecting sections that eject ink for printing the highlight region and as ink ejecting sections that do not eject ink therefor, it becomes possible to print the highlight region with ink ejecting sections that have high precision in positions where dots are formed. That is, by assigning the first ink ejecting section that is set to print the highlight region in the image to the ink ejecting section that has high precision in positions where dots are formed, it becomes possible to improve the image quality of the highlight region and thereby print high-quality images.

In the image forming apparatus, it is preferable that the image is printed with dots that are in at least two sizes and that are formed with the ink ejected from the ink ejecting sections; and among the dots that are in the at least two sizes, dots that are formed for printing the highlight region with the ink ejected from the first ink ejecting section are dots other than dots of the largest size.

By using small dots to print the low-darkness highlight region, it is possible to print the highlight region such that the darkness changes gradually and smoothly. However, if the precision in positions where the small dots are formed is low, graininess will arise in the image. Therefore, in the present printing apparatus, dots other than the largest dots are printed using the first ink ejecting section, and the first ink ejecting section, which prints the dots other than the largest dots, is set to be the ink ejecting section that is capable of forming dots at high precision. In this way, it becomes possible to improve the image quality in the highlight region, and thereby print high-quality images.

In the printing apparatus, it is preferable that among the dots other than the dots of the largest size, the dots that are formed for printing the highlight region with the ink ejected from the first ink ejecting section are dots of the smallest size.

If the precision in positions where the smallest dots are formed is low, graininess in the image tends to stand out. However, according to the present printing apparatus, by setting the first ink ejecting section, which prints the smallest dots, to be the ink ejecting section that is capable of forming dots at high precision, it becomes possible to print high-quality images.

In the printing apparatus, it is preferable that the image is printed with at least two kinds of dots formed using a plurality of kinds of inks that differ in darkness and that are ejected from the ink ejecting sections; and among the at least two kinds of dots, dots that are formed for printing the highlight region with the ink ejected from the first ink ejecting section are dots formed using ink other than the darkest ink.

By using light ink for printing the highlight region, the image quality will improve. According to the present printing apparatus, the first ink ejecting section is set to print the dots formed by light ink, that is, the ink other than the darkest ink, and the first ink ejecting section is set to be the ink ejecting section that is capable of forming dots at high precision. In this way, it becomes possible to print high-quality images.

In the printing apparatus, it is preferable that among the dots formed using ink other than the darkest ink, the dots that are formed for printing the highlight region with the ink ejected from the first ink ejecting section are dots formed using the lightest ink.

According to such a printing apparatus, by setting the first ink ejecting section, which forms the dots using the lightest ink, to be the ink ejecting section that is capable of forming dots at high precision, it becomes possible to further improve the image quality of the images printed.

In the printing apparatus, it is preferable that the inks that differ in darkness include cyan ink, light cyan ink that is lighter than the cyan ink, magenta ink, and light magenta ink that is lighter than the magenta ink; and the dots that are formed for printing the highlight region with the ink ejected from the first ink ejecting section are dots formed using the light cyan ink and the light magenta ink.

According to such a printing apparatus, the ink ejecting section that prints dots formed by light cyan ink and light magenta ink, which are particularly used for printing the highlight region, is set to be the first ink ejecting section, and the first ink ejecting section is set to be the ink ejecting section that is capable of forming dots at high precision. In this way, it becomes possible to improve the image quality of the images printed.

In the printing apparatus, it is preferable that when assuming that a darkness level of the darkest region in the image is 100%, the darkness level of the highlight region is at most 35%.

If the precision in positions where dots are formed is low for the dots that form the portions where the darkness level is 35% or less, graininess in the image tends to stand out. However, according to the present printing apparatus, the dots that form the portions where the darkness level is 35% or less are formed by the first ink ejecting section, which is capable of forming dots at high precision. In this way, it becomes possible to improve the image quality of the images printed.

In the printing apparatus, it is preferable that the printing apparatus further comprises a holding section for movably holding the ink ejecting sections, and a moving member that engages the holding section and that is for causing the holding section to move; the dots are formed by ejecting ink from the ink ejecting sections while causing the holding section to move using the moving member; and the first ink ejecting section is an ink ejecting section, among the ink ejecting sections, that is located on the side closer to an engaging section where the holding section and the moving member engage.

In such a printing apparatus, when the holding section, which holds the ink ejecting sections, is moved by the moving member, motion is transmitted to the holding section from the engaging section between the moving member and the holding section. During movement of the holding section, the portions of the holding section other than the engaging section are delayed in motion compared to the engaging section. Further, the restriction force applied to the portions of the holding section other than the engaging section is weak because those portions are not engaged to the moving member. Therefore, during movement of the holding section, the holding section is caused to vibrate or oscillate about the engaging section. This vibration or oscillation becomes larger as the distance from the engaging section becomes larger. This means that the precision in positions where dots are formed decreases for ink ejecting sections that are located further from the engaging section. Therefore, the dots formed for printing the highlight region are ejected from the ink ejecting sections that are located on the side closer to the engaging section between the holding section and the moving member. In this way, it becomes possible to particularly precisely print the dots that form the highlight region in the image.

In the printing apparatus, it is preferable that the ink ejecting sections are grouped into at least two groups; each group of the ink ejecting sections forms an ink ejecting unit; and the ink ejecting section that is located on the side closer to the engaging section is an ink ejecting section that is included in an ink ejecting unit that is located on the side closer to the engaging section.

According to such a printing apparatus, the plurality of ink ejecting sections are grouped into several groups, and dots to be formed are set for each group. Therefore, it is easy to activate and control the ink ejecting sections.

In the printing apparatus, it is preferable that all of the ink ejecting sections are allowed to eject ink for printing regions other than the highlight region.

According to such a printing apparatus, since the ink ejecting sections that are set to eject ink for printing the highlight region can also print the regions other than the highlight region, the regions other than the highlight region are printed using all of the ink ejecting sections. Therefore, it becomes possible to perform printing at high speed.

In the printing apparatus, it is preferable that the setting for the ink ejecting sections is changed according to print modes.

According to such a printing apparatus, for example, as for print modes for printing images that do not require an especially high quality, printing is performed using all of the ink ejecting sections, regardless of whether the printed region is the highlight region or not. Therefore, it becomes possible to carry out printing attaching importance to print speed for print modes that do not require high image quality, and printing attaching importance to image quality for print modes that require high image quality. Here, "print mode" refers to, for example, the so-called high speed mode, the high image quality mode, or the highly-precise mode, which differ, for example, in resolution of images printed or in carry amount of the medium to be printed.

In the printing apparatus, it is preferable that the medium to be printed is printed on while being carried in a predetermined direction; the ink ejecting sections are arranged in a row in the direction in which the medium to be printed is carried to form a row of ink ejecting sections; and the first ink ejecting section is at most half of continuously-arranged ink ejecting sections among all ink ejecting sections belonging to the row of ink ejecting sections.

According to such a printing apparatus, it becomes possible that the ink ejecting section row is used by dividing it into half, for example, and the ink ejecting sections provided in one half of the row are set to be the ink ejecting section used for printing the regions other than the highlight region, and the ink ejecting sections provided in the other half of the row are set to be the ink ejecting section that is capable of forming the dots for the highlight region. Such a configuration is applicable also to printing methods such as the so-called interlace mode printing in which ink ejecting sections provided in different regions of the ink ejecting section row are successively used to print the same region on the medium to be printed. That is, by setting at most half of continuously-arranged ink ejecting sections, among all ink ejecting sections belonging to the row of ink ejecting sections, as the ink ejecting section that is capable of forming the dots for the highlight region, it becomes possible to perform interlace-mode printing requiring high image quality.

Another aspect of the present invention is a printing apparatus comprising: a plurality of ink ejecting sections for ejecting ink, wherein:

the printing apparatus prints an image on a medium to be printed by ejecting ink from the ink ejecting sections;

the ink ejecting sections include a first ink ejecting section that is set to eject ink for printing a highlight region in the image, the highlight region being a region in which, when assuming that a darkness level of the darkest region in the image is 100%, the darkness level of the highlight region is at most 35%, and a second ink ejecting section that is set not to eject the ink for printing the highlight region in the image;

all of the ink ejecting sections are allowed to eject ink for printing regions other than the highlight region;

the setting for the ink ejecting sections is changed according to print modes;

the image is printed with at least two kinds of dots that are formed with the ink ejected from the ink ejecting sections and that are formed by dots that are in at least two sizes and that are formed with the ink ejected from the ink ejecting sections, and by using cyan ink, light cyan ink that is lighter than the cyan ink, magenta ink, and light magenta ink that is lighter than the magenta ink, which differ in darkness;

the dots that are formed for printing the highlight region with the ink ejected from the first ink ejecting section are either dots of the smallest size among the dots that are in at least two sizes, or dots formed using the light cyan ink and the light magenta ink;

the printing apparatus further comprises a holding section for movably holding the ink ejecting sections, and a moving member that engages the holding section and that is for causing the holding section to move;

the ink ejecting sections are grouped into at least two groups;

each group of the ink ejecting sections forms an ink ejecting unit;

the dots are formed by ejecting ink from the ink ejecting sections while causing the holding section to move using the moving member;

the first ink ejecting section is an ink ejecting section, among the ink ejecting sections, that is included in an ink ejecting unit located on the side closer to an engaging section where the holding section and the moving member engage;

the medium to be printed is printed on while being carried in a predetermined direction;

the ink ejecting sections are arranged in a row in the direction in which the medium to be printed is carried to form a row of ink ejecting sections; and the first ink ejecting section is at most half of continuously-arranged ink ejecting sections among all ink ejecting sections belonging to the row of ink ejecting sections.

According to such a printing apparatus, it becomes possible to provide a printing apparatus that performs printing with particularly high precision since almost all of the effects described above, such as that it is possible to print dots formed in the highlight region of the image—such as the smallest dots and the dots formed with light ink—in their target dot-forming positions with particularly high precision, can be obtained.

It is also possible to provide a computer-readable storage medium having recorded thereon a program for causing a printing apparatus comprising a plurality of ink ejecting sections for ejecting ink, wherein the printing apparatus prints an image on a medium to be printed by ejecting ink from the ink ejecting sections; and wherein the ink ejecting sections include a first ink ejecting section that is set to eject ink for printing a highlight region in the image, and a second ink ejecting section that is set not to eject the ink for printing the highlight region in the image, to print the highlight region by making the first ink ejecting section eject ink.

It is also possible to provide a computer system comprising: a computer; and a printing apparatus that is connected to the computer and that includes a plurality of ink ejecting sections for ejecting ink, wherein the printing apparatus prints an image on a medium to be printed by ejecting ink from the ink ejecting sections; and wherein the ink ejecting sections include a first ink ejecting section that is set to eject ink for printing a highlight region in the image, and a second ink ejecting section that is set not to eject the ink for printing the highlight region in the image.

It is also possible to provide a method for printing using a printing apparatus that includes a plurality of ink ejecting sections for ejecting ink, wherein the printing apparatus prints an image on a medium to be printed by ejecting ink from the ink ejecting sections; and wherein the ink ejecting sections include a first ink ejecting section that is set to eject ink for printing a highlight region in the image, and a second ink ejecting section that is set not to eject the ink for printing the highlight region in the image, the method comprising the step of: printing an image by causing the first ink ejecting section and the second ink ejecting section to eject ink.

It is also possible to provide a method for manufacturing a printed article that is printed using a printing apparatus that includes a plurality of ink ejecting sections for ejecting ink, wherein the printing apparatus prints an image on a medium to be printed by ejecting ink from the ink ejecting sections; and wherein the ink ejecting sections include a first ink ejecting section that is set to eject ink for printing a highlight region in the image, and a second ink ejecting section that is set not to eject the ink for printing the highlight region in the image, the method comprising the step of: printing an image by causing the first ink ejecting section and the second ink ejecting section to eject ink.

Another aspect of the present invention is a printing apparatus comprising: a plurality of ink ejecting sections for ejecting ink, wherein the printing apparatus prints an image on a medium to be printed by ejecting ink from the ink ejecting sections; and wherein the ink ejecting section to be used for ejecting ink to print a portion of the image is determined, from among the ink ejecting sections, according to the darkness of the portion.

As described above, by grouping the plurality of ink ejecting sections into a first ink ejecting section for printing the highlight region in the image and a second ink ejecting section that does not print the highlight region, it is possible to improve the image quality of the highlight region in the image. Other than such a configuration, however, the ink ejecting section to be used for ejecting ink to print a portion of the image may be determined, from among the plurality of ink ejecting sections, according to the darkness of that portion. In this way, it becomes possible to print portions of the image that differ in darkness using ink ejecting sections that suit the darkness.

For example, the portions of the image may be grouped into n groups (n is an integer of two or more) according to, for example, their gradation values (described later). The plurality of ink ejecting sections may also be divided into n groups. Each of the groups of ink ejecting sections may be associated with a portion of the image grouped according to darkness. This associating process may be done as follows. For example, an ink ejecting section group capable of printing at high precision, an ink ejecting section group capable of ejecting small ink droplets, or an ink ejecting section group capable of ejecting light-color ink may be associated with a portion of the image being comparatively light in darkness. Further, for example, an ink ejecting section group capable of printing at high speed may be associated with a comparatively dark portion of the image.

EXAMPLES OF OVERVIEW OF PRINTING APPARATUS

Figure 2:
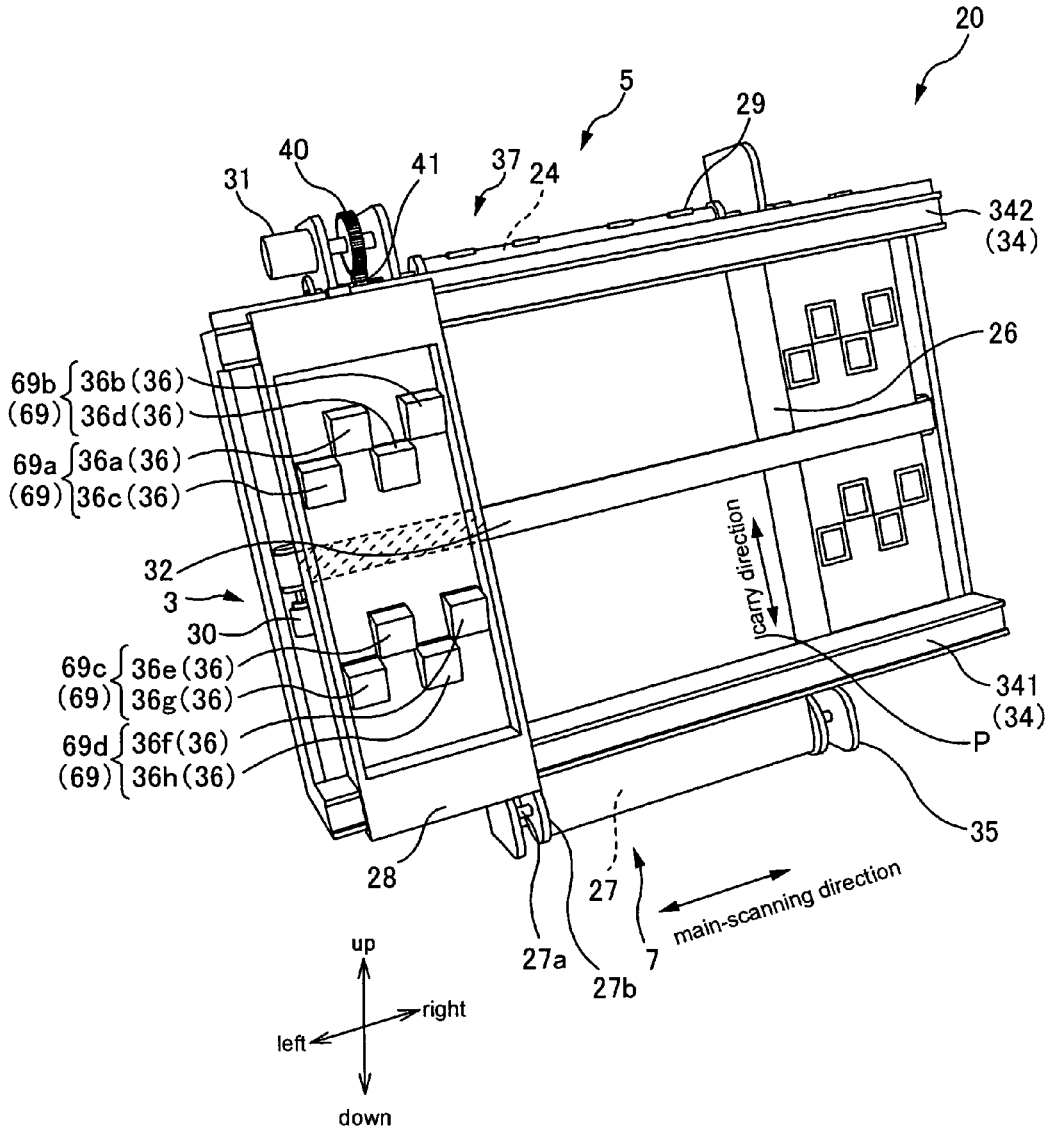
FIG. 2 is a perspective view showing a state in which the carriage has been moved in the color printer of FIG. 1.

FIG. 1 and FIG. 2 are perspective views showing an overview of a color inkjet printer (referred to as "color printer" below) as a first embodiment of a printing apparatus. The color printer 20 is an inkjet printer that is capable of outputting color images. It is an inkjet-type printer that prints images by ejecting color ink of, for example, six colors—cyan (C), light cyan (pale cyan, LC), magenta (M), light magenta (pale magenta, LM), yellow (Y), and black (K)—onto various printing media (i.e., media to be printed) such as print paper to form dots thereon. It should be noted that the color ink is not limited to the six colors described above, and dark yellow (dim yellow, DY), for example, can be used. Further, the color printer 20 is also adapted to roll paper, in which print paper serving as the printing medium is wrapped into a roll, and single-sheet print paper of a relatively large size such as the paper sheets of A0 size or B0 size according to the JIS standard. In the example shown in FIG. 1 and FIG. 2, the color printer 20 has roll paper on it; the position of the carriage 28 provided in the color printer 20 differs between FIG. 1 and FIG. 2. Details on the carriage 28 will be described later.

As shown in the figures, the color printer 20 has a printing section 3 for printing on roll paper P by ejecting ink thereon, and a print paper carrying section 5 for carrying the print paper.

Printing Section 3

The printing section 3 includes a carriage 28 that serves as a holding section for holding a plurality of print heads 36, a carriage motor 30 for making the carriage 28 move back and forth in a direction (referred to as "main-scanning direction" below) approximately orthogonal to a direction in which the roll paper P is carried (referred to as "sub-scanning direction" below), a metal pull belt 32 that structures a moving member together with the carriage motor 30 and that is driven by the carriage motor 30 to move the carriage 28, and two guide rails 34 for guiding the carriage 28.

The two guide rails 34 are provided along the main-scanning direction, are arranged at the upper and lower sides in the sub-scanning direction spaced apart from each other, and are supported at both left and right ends by a frame (not shown) that serves as a base. As for the two guide rails 34, the lower guide rail 341 is arranged in front of the upper guide rail 342. Accordingly, the carriage 28 that is arranged extending between the two guide rails 341 and 342 moves in a state in which its upper portion is inclined toward the rear.

The pull belt 32 is annular and runs between two pulleys 44 and 45, which are spaced apart from each other at a length approximately the same as the length of each of the upper and lower guide rails 341 and 342, at a position in the center of the guide rails 341 and 342. One of the two pulleys 44 and 45 (the pulley 44 in this embodiment) is connected to the carriage motor 30.

The carriage 28, which is arranged extending between the two guide rails 341 and 342, has an engaging section 46 to which the pull belt 32 is fixed at approximately the center in the vertical direction. The carriage 28 is pulled by the pull belt 32 driven by the carriage motor 30 and moves along the guide rails 34 in the main-scanning direction, and ink is ejected from the eight print heads 36 that are provided on the carriage 28. Accordingly, the color printer 20 prints on the roll paper P carried by the print paper carrying section 5.

In the present embodiment, eight print heads 36 are provided on the carriage 28. Each print head 36 has a plurality of nozzles n, serving as "ink ejecting sections", for ejecting ink, and each head 36 ejects ink from the predetermine ones of the nozzles n under control of the head control unit 63 (refer to FIG. 10) described later. The surface of each print head 36 opposing the roll paper P includes a plurality of nozzle rows N, serving as "rows of ink ejecting sections", in which the plurality of nozzles n are arranged in rows in the sub-scanning direction. These nozzle rows N are arranged parallel to each other in the main-scanning direction. The arrangement of the print heads 36 and the nozzles n will be described later.

Print Paper Carrying Section 5

The print paper carrying section 5 is provided behind the two guide rails 34. The print paper carrying section 5 includes a roll paper holding section 35, a roll paper carrying section 37, and a platen 26. The roll paper holding section 35, along with a holder 27, rotatably holds the roll paper P below the lower guide rail 341. The roll paper carrying section 37 carries the roll paper P at a position above the upper guide rail 342. The platen 26 supports the roll paper P that is carried between the roll paper holding section 35 and the roll paper carrying section 37. The platen 26 has a surface that covers the entire width of the roll paper P being carried. The surface of the platen 26 is provided in an inclined manner so that each of the print heads 36 provided on the carriage 28, which moves in an inclined state, opposes the surface at an equal spacing.

The holder 27 has a shaft 27*a* that serves as a rotating shaft when the roll paper P is held thereon. Guide disks 27*b* are provided at each end of the shaft 27*a* to prevent the supplied roll paper P from being carried in a winding state.

The roll paper carrying section 37 includes a paper feed roller (SMAP roller) 24 for carrying the roll paper P, nipping rollers 29 that are arranged opposed to the paper feed roller 24 and that nip the roll paper P between them and the paper feed roller 24, and a carry motor 31 for making the paper feed roller 24 rotate. A drive gear 40 is provided on the shaft of the carry motor 31, and an intermediate gear 41 that meshes with the drive gear 40 is provided on the shaft of the paper feed roller 24. The motion of the carry motor 31 is thereby transmitted to the paper feed roller 24 via the drive gear 40 and the intermediate gear 41. That is, the roll paper P held by the holder 27 is nipped between the paper feed roller 24 and the nipping rollers 29 and is carried over the platen 26 by the carry motor 31.

Figure 3:
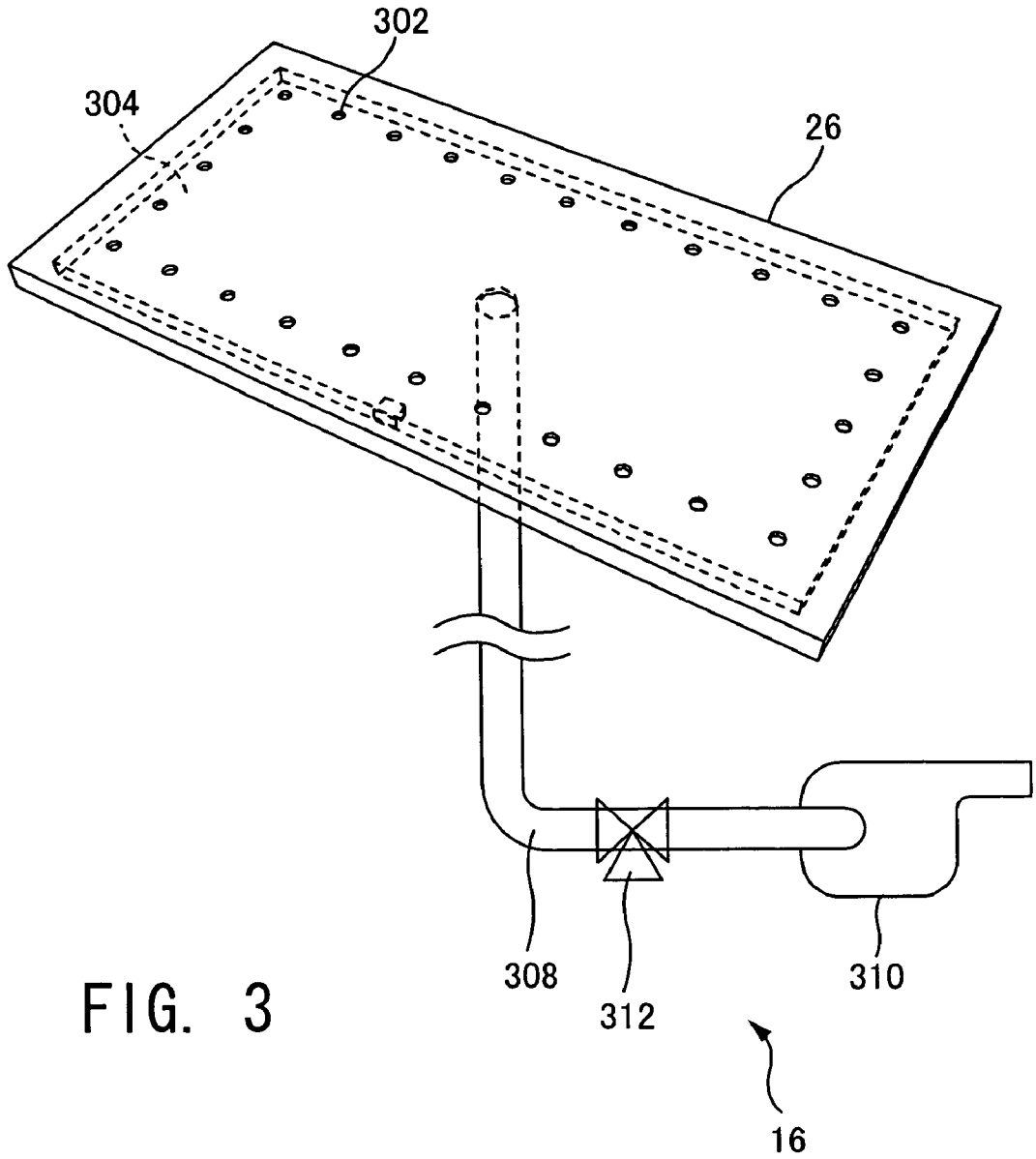
FIG. 3 is a conceptual diagram illustrating a suction mechanism of a platen.

FIG. 3 is a conceptual diagram illustrating a suction mechanism 16 of the platen 26. As shown in the figure, numerous suction apertures 302 are provided annularly along the rim of the platen 26 and on the side of the platen 26 on which the roll paper P is carried. Those apertures 302 are in communication with a chamber 304 provided on the inner side of the platen 26. The chamber 304 is in communication with a suction mechanism 16 that is provided on the back of the platen 26 and that sucks the air within the chamber 304. In other words, the suction mechanism 16 is in communication with the area outside the platen 26 via the numerous suction apertures 302 and the chamber 304.

The suction mechanism 16 has a suction blower 310 for sucking in the air within the chamber 304 to cause negative pressure therein and make the chamber 304 a vacuum, a hose 308 connecting the suction blower 310 and the chamber 304, and a switch valve 312 provided in the hose 308 between the suction blower 310 and the chamber 304. The switch valve 312 is constituted by an electromagnetic three-way valve that has an air release opening.

When the suction blower 310 is driven, the pressure within the chamber 304 drops, and the roll paper P carried along the platen 26 is sucked via the numerous suction apertures 302. Thus, the roll paper P is carried along the platen 26 in a flat state without warping. It should be noted that, by switching the switch valve 312, it is possible for the suction mechanism 16 to release atmospheric air into the chamber 304. Above, an example in which the numerous suction apertures 302 are provided annularly along the rim of the platen 26 was described; however, they may be provided at an equal spacing, for example, over the entire surface of the platen 26. This would allow the roll paper P to adequately adhere to the entire surface, and has the benefit that cockling, for example, is less likely to occur.

Configuration of Print Heads

Figure 4:
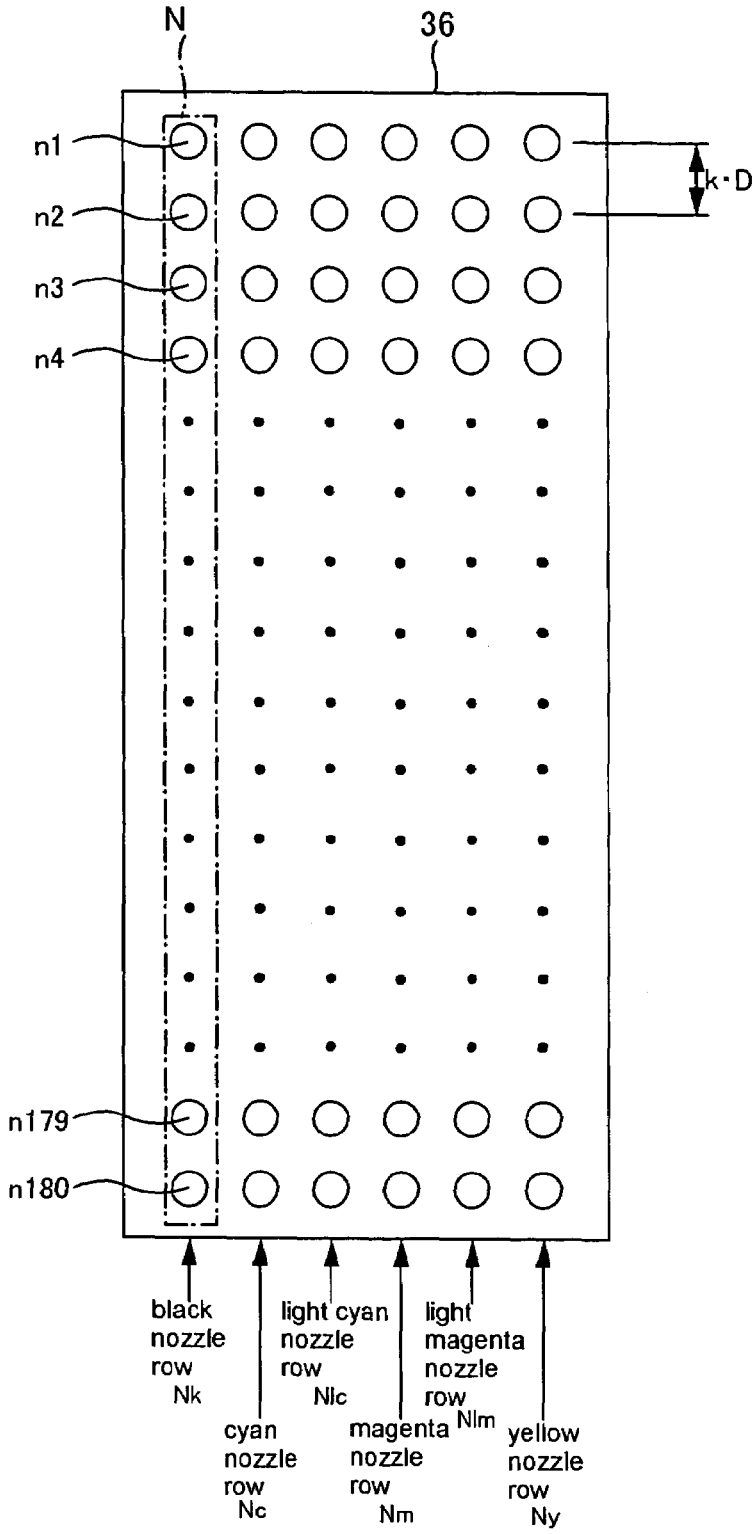
FIG. 4 is an explanatory diagram for illustrating nozzle rows of a print head.
Figure 5:
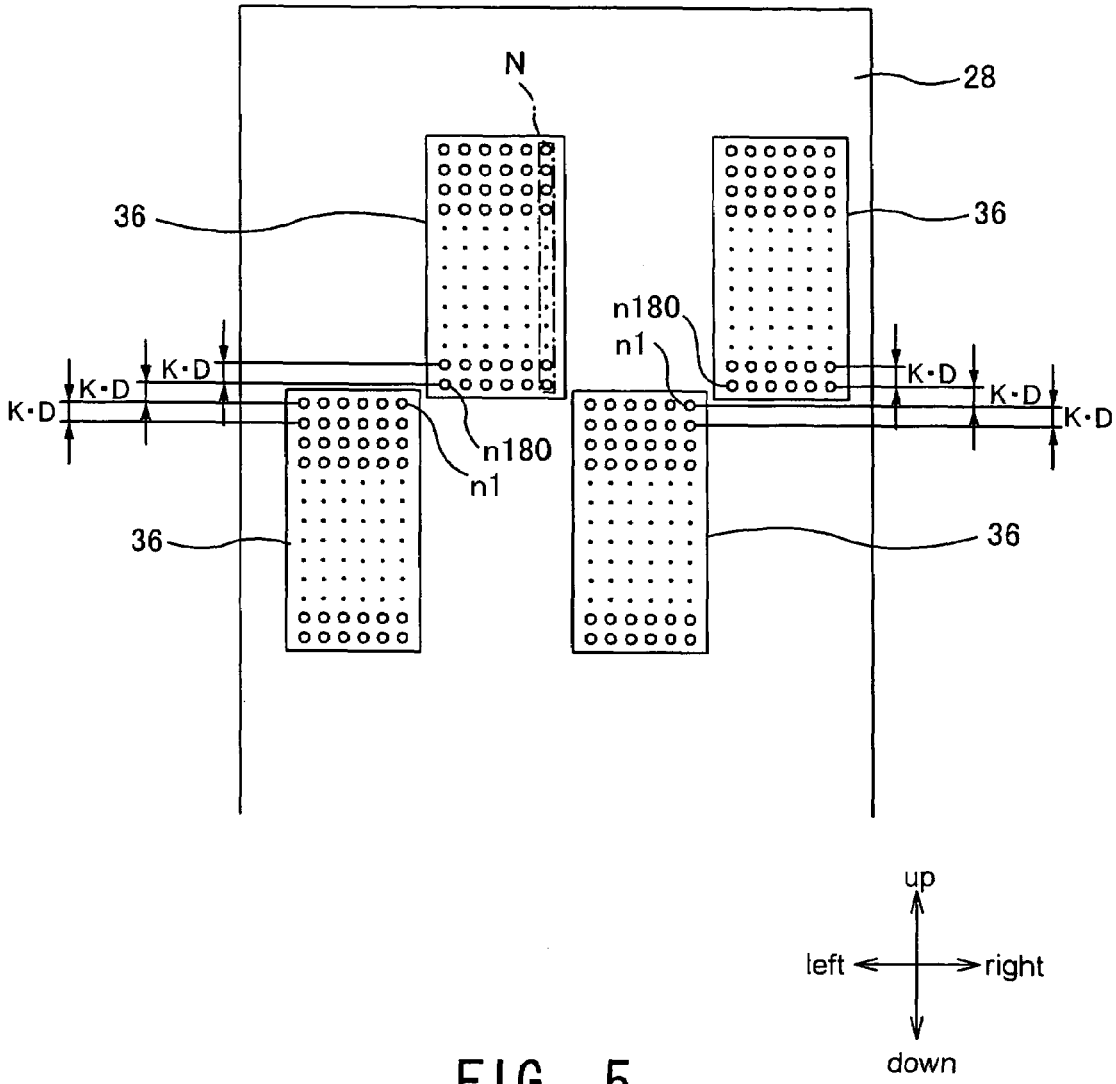
FIG. 5 is a diagram for illustrating the arrangement of nozzles among adjacent print heads.

Next, FIG. 1, FIG. 4, and FIG. 5 are used to describe the configuration of the print heads 36. FIG. 4 is an explanatory diagram for describing the arrangement of the nozzles of a print head 36. FIG. 5 is a diagram showing the arrangement of plurality of adjacent print heads 36 and the positional relationship between the nozzle rows of those print heads 36.

Each print head 36, as shown in FIG. 4, has six nozzle rows N, serving as the rows of ink ejecting sections, in which the plurality of nozzles n are arranged in straight lines in the sub-scanning direction. In the present embodiment, the nozzle rows N—such as the black nozzle row Nk, the cyan nozzle row Nc, the light cyan nozzle row Nlc, the magenta nozzle row Nm, the light magenta nozzle row Nlm, and the yellow nozzle row Ny—are provided for each color of ink that is ejected. However, this is not a limitation.

The black nozzle row Nk has 180 nozzles, that is, nozzles n1 to n180. Each nozzle n is provided with a piezo-element (not shown) as an activation element for activating each nozzle n to make it eject ink droplets. The nozzles n1, . . . , n180 of the black nozzle row Nk are arranged at a constant nozzle pitch k·D in the sub-scanning direction. Here, D is the dot pitch in the sub-scanning direction, and k is an integer of one or more. The dot pitch D in the sub-scanning direction is equal to the pitch of the main scan lines (raster lines), which are lines formed in the main scanning direction by the dots. Hereinafter, the integer k expressing the nozzle pitch k·D is referred to simply as the "nozzle pitch k." In the example of FIG. 4, the nozzle pitch k is four dots. The nozzle pitch k, however, may be set to any integer.

The above-described matters also apply to the cyan nozzle row Nc, the light cyan nozzle row Nlc, the magenta nozzle row Nm, the light magenta nozzle row Nlm, and the yellow nozzle row Ny. That is, each of these nozzle rows has 180 nozzles n1 to n180 arranged at a constant nozzle pitch k·D in the sub-scanning direction.

At the time of printing, the roll paper P is intermittently carried with the print paper carrying section 5 by a predetermined carry amount, and during this intermittent carry, droplets of ink are ejected from each nozzle n as the carriage 28 is moved in the main-scanning direction. However, depending on the print mode, there are instances in which only some of the nozzles n are used and not all the nozzles n are used.

Among the eight print heads 36 provided on the carriage 28, four print heads 36 are arranged above the pull belt 32, and the other four print heads 36 are arranged below the pull belt 32. Since the positional relationship for each of the four upper and lower print heads 36 is the same, only the positional arrangement among the four upper print heads 36 will be described below as an example.

Among the four upper print heads 36, two print heads 36*a* and 36*b* that are located on the side further from the engaging section 46 between the carriage 28 and the pull belt 32 and that serve as a "second ink ejecting section" are arranged on the upper side, and two print heads 36*c* and 36*d* that are located on the side closer to the engaging section 46 and that serve as a "first ink ejecting section" are arranged on the lower side. The two upper print heads 36*a* and 36*b*, as well as the two lower print heads 36*c* and 36*d*, are spaced apart from each other in the lateral direction at a length that is approximately equal to the width of the print head 36. The upper right print head 36*b* on the right is located at the right end of the carriage 28. The lower print head 36*c* on the left is located at the left end of the carriage 28. That is, among the four print heads 36*a*, 36*b*, 36*c*, and 36*d*, the two print heads 36*a* and 36*c* on the left form a pair and the two print heads 36*b* and 36*d* on the right form another pair, and in each pair of print heads 36, the print heads 36*c* and 36*d* on the left are located on the lower side, and the print heads 36*a* and 36*b* on the right are located on the upper side; that is, the four print heads 36 are in a staggered arrangement. The four print heads arranged below the pull belt 32 are also arranged in two rows, with two print heads each, in the vertical direction. It is needless to say that, as for the four lower print heads, the upper print heads 36*e* and 36*f* form the first ink ejecting section located on the side closer to the engaging section 46, and the lower print heads 36*g* and 36*h* form the second ink ejecting section located on the side further from the engaging section 46.

Further, as shown in FIG. 5, as for the four print heads 36 arranged above the pull belt 32, the lowermost nozzle n180 of each nozzle row N in each of the upper print heads and the uppermost nozzle n1 of each nozzle row N in each of the lower print heads are arranged at a pitch equal to the nozzle pitch of each nozzle row N. That is, as for the two print heads 36*a* and 36*c* arranged on the left, the space, in the vertical direction, between the lowermost nozzle n180 (the rearmost nozzle in the paper carry direction) of each nozzle row N in the upper right print head 36*a* and the uppermost nozzle n1 (the foremost nozzle in the paper carrying direction) of each nozzle row N in the lower left print head 36*c* is arranged so that it is equal to the nozzle pitch k·D. In the same way, as for the two print heads 36*b* and 36*d* arranged on the right, the space, in the vertical direction, between the lowermost nozzle n180 of each nozzle row N in the upper right print head 36*b* and the uppermost nozzle n1 of each nozzle row N in the lower left print head 36*d* is arranged so that it is equal to the nozzle pitch k·D. Therefore, assuming that the two left print heads 36*a* and 36*c* form a print head group and the two right print heads 36*b* and 36*d* form another print head group, when each nozzle row N in each print head group forms dots on the roll paper P at the same position in the main-scanning direction during one scan movement of the carriage, the dots formed by the nozzle rows N of the two print heads 36 in the same group will form a continuous line at a constant pitch. That is, by controlling the timing to eject ink from the nozzle rows N of the two print heads 36 in the same group, it becomes possible to assume that the nozzle rows N are in one continuous nozzle row. In this way, it becomes possible to print at high speed even when printing a large image on a large-size print paper.

It should be noted that in FIG. 4, the ink colors of each of the nozzle rows were, in order from the left side in the figure, the black nozzle row Nk, the cyan nozzle row Nc, the light cyan nozzle row Nlc, the magenta nozzle row Nm, the light magenta nozzle row Nlm, and the yellow nozzle row Ny; however, this is not a limitation, and it is also possible for the ink colors of each nozzle row N to be arranged in a different order.

Actuating The Print Head

Next, the way in which the print head 36 is driven will be described below with reference to FIG. 6 and FIG. 7.

Figure 6:
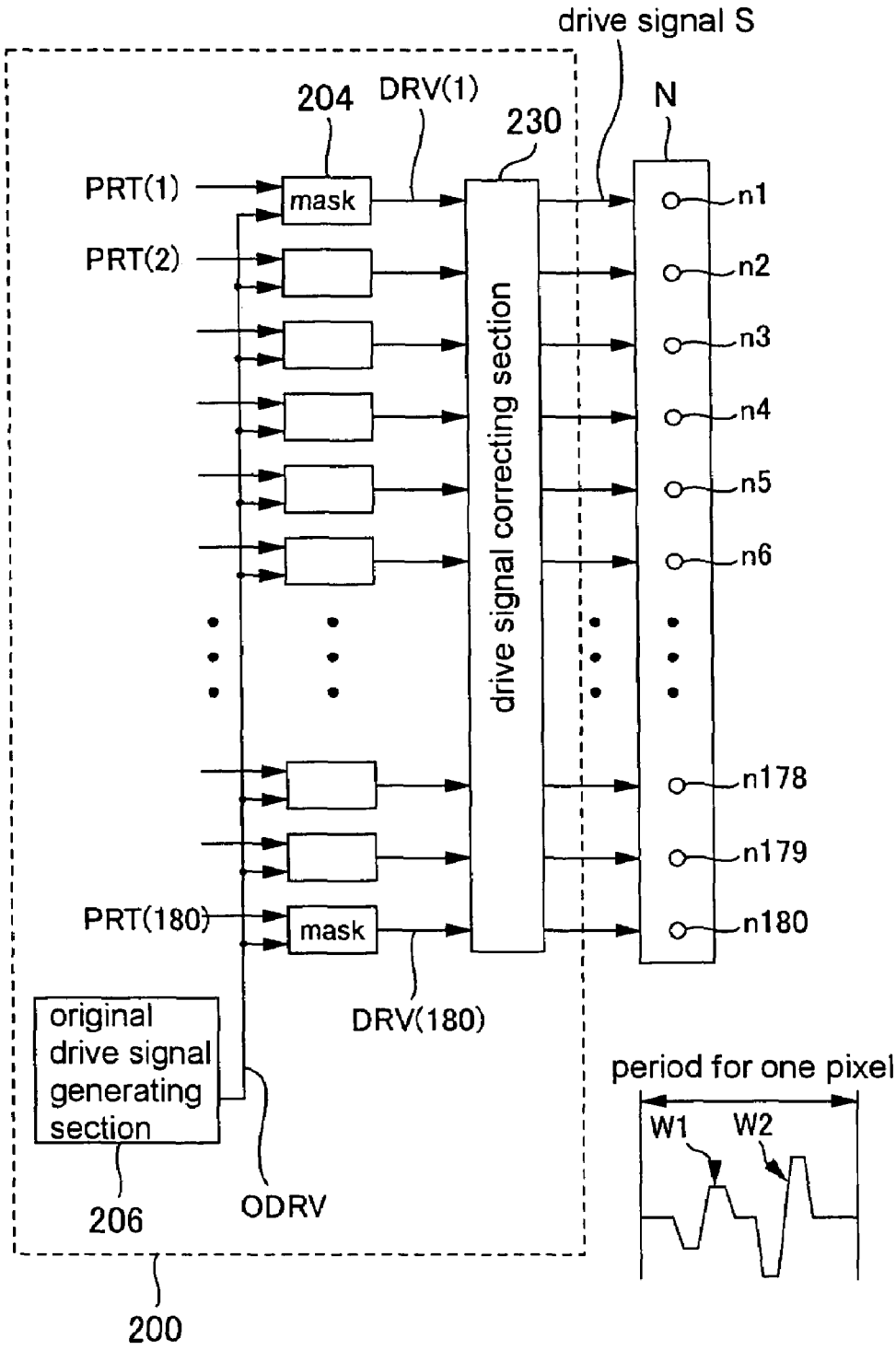
FIG. 6 is a diagram showing the configuration of a drive signal generating section provided in a head control unit.
Figure 9:
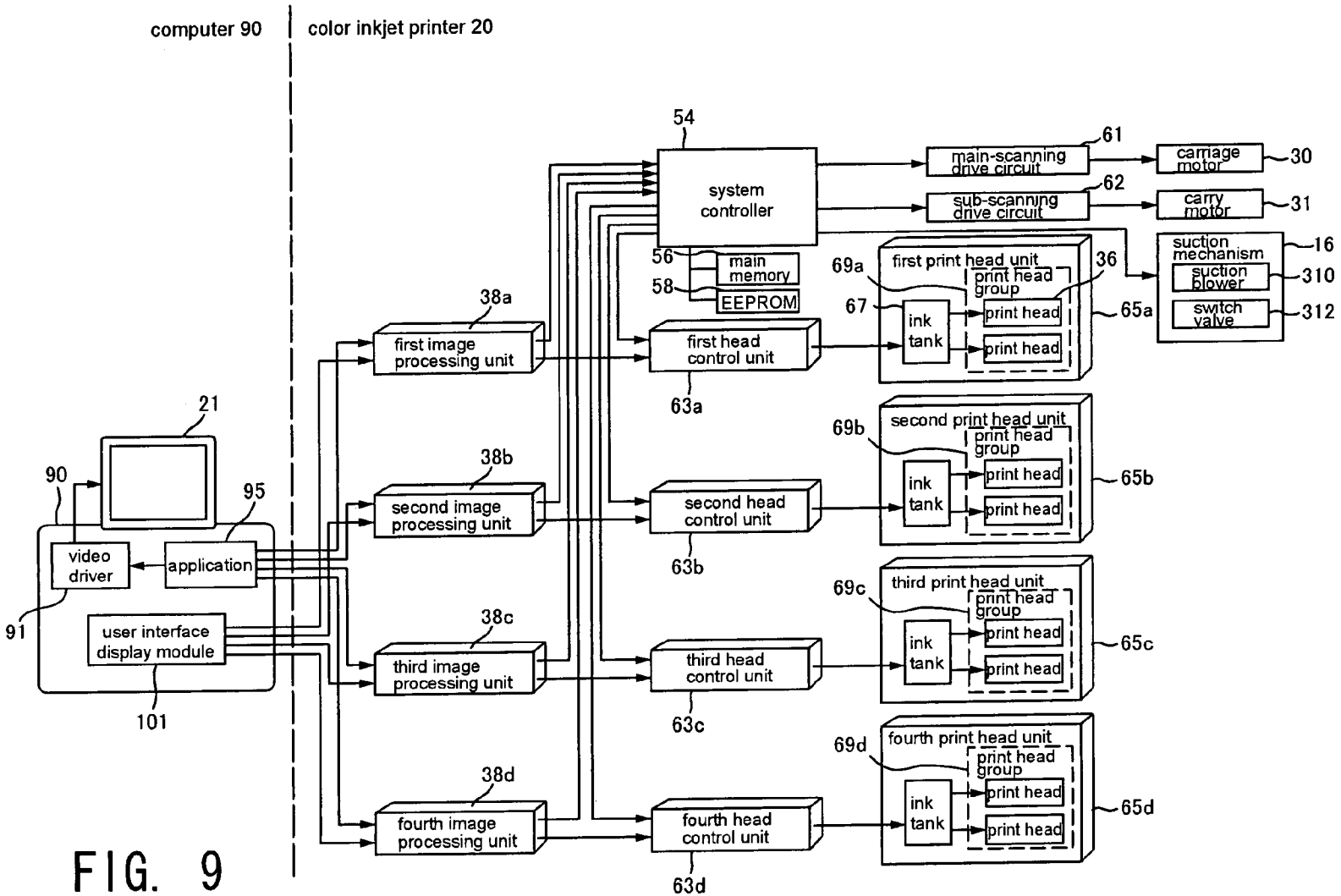
FIG. 9 is a block diagram showing the configuration of a printing system provided with the color printer.

FIG. 6 is a block diagram showing the configuration of a drive signal generating section provided in the head control unit 63 (see FIG. 9). FIG. 7 is a timing chart for the original drive signal ODRV, the print signal PRT(i), and the drive signal DRV(i), which show the operation of the drive signal generating section.

As shown in FIG. 6, the drive signal generating section 200 includes a plurality of mask circuits 204, an original drive signal generating section 206, and a drive signal correcting section 230. The mask circuits 204 are provided corresponding to each of the plurality of piezo elements for activating each of the nozzles n1 through n180 of the print head 36. Note that in FIG. 6, the number in parentheses attached to the end of each signal name indicates the number of the nozzle to which the signal is supplied.

The original drive signal generating section 206 generates original drive signals ODRV used in common among the nozzles n1 through n180. The original drive signal ODRV is a signal that includes two pulses—a first pulse W1 and a second pulse W2—during the main scan period for one pixel.

The drive signal correcting section 230 performs correction by shifting, either forward or backward for the whole return pass, the timing of the drive signal waveform that has been shaped by each mask circuit 204. By correcting the timing of the drive signal waveform, the misalignment (alignment error) between the positions at which the ink droplets land during the forward pass and the return pass is corrected. That is, the misalignment between the positions at which the dots are formed during the forward pass and the return pass is corrected.

As shown in FIG. 6, input serial print signals PRT(i) are then input to the mask circuits 204 along with the original drive signal ODRV that has been output from the original drive signal generating section 206. The serial print signal PRT(i) is a serial signal made of two bits per pixel, and each bit corresponds to the first pulse W1 and the second pulse W2, respectively. Each mask circuit 204 is a gate for masking the original drive signal ODRV according to the level of the serial print signal PRT(i). That is, if the serial print signal PRT(i) is at level 1, the mask circuit 204 lets the corresponding pulse of the original drive signal ODRV pass right through so that the pulse can be supplied to the piezo element as a drive signal DRV, whereas if the serial print signal PRT(i) is at level 0, the mask circuit 204 cuts off the corresponding pulse of the original drive signal ODRV.

Figure 7:
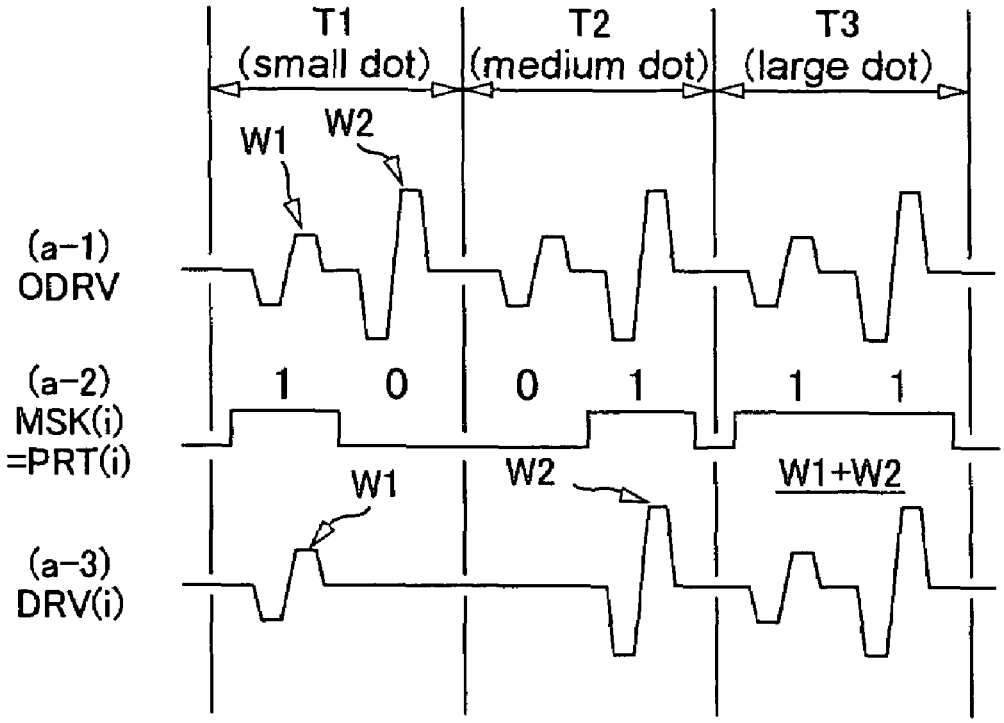
FIG. 7 is a timing chart showing the operation of the drive signal generating section.

As shown in FIG. 7, the original drive signal generating section 206 generates an original drive signal ODRV in which the first pulses W1 and the second pulses W2 alternately appear for each of the pixel periods T1, T2, and T3. It should be noted that the term "pixel period" means the period for the main-scanning movement for one pixel.

As shown in FIG. 7, when the print signal PRT(i) has a waveform corresponding to 2-bit pixel data "1, 0", then only the first pulse W1 is output during the first half of the pixel period. Accordingly, a small ink droplet is ejected from the nozzle, and a small dot is formed on the medium to be printed. On the other hand, when the print signal PRT(i) has a waveform corresponding to 2-bit pixel data "0, 1", then only the second pulse W1 is output during the latter half of the pixel period. Accordingly, a medium-sized ink droplet is ejected from the nozzle, and a medium-sized dot (medium dot) is formed on the medium to be printed. Further, when the print signal PRT (i) has a waveform corresponding to 2-bit pixel data "1, 1", then both the first pulse W1 and the second pulse W2 are output during the pixel period. Accordingly, a large ink droplet is ejected from the nozzle, and a large dot is formed on the medium to be printed. That is, the drive signal DRV(i) for one pixel period is shaped so that its waveform is in one of the three different shapes according to the three different values of the print signal PRT(i). According to these signals, the print head 36 is enabled to form dots in three sizes.

Configuration of Dots Forming an Image

Figure 8:
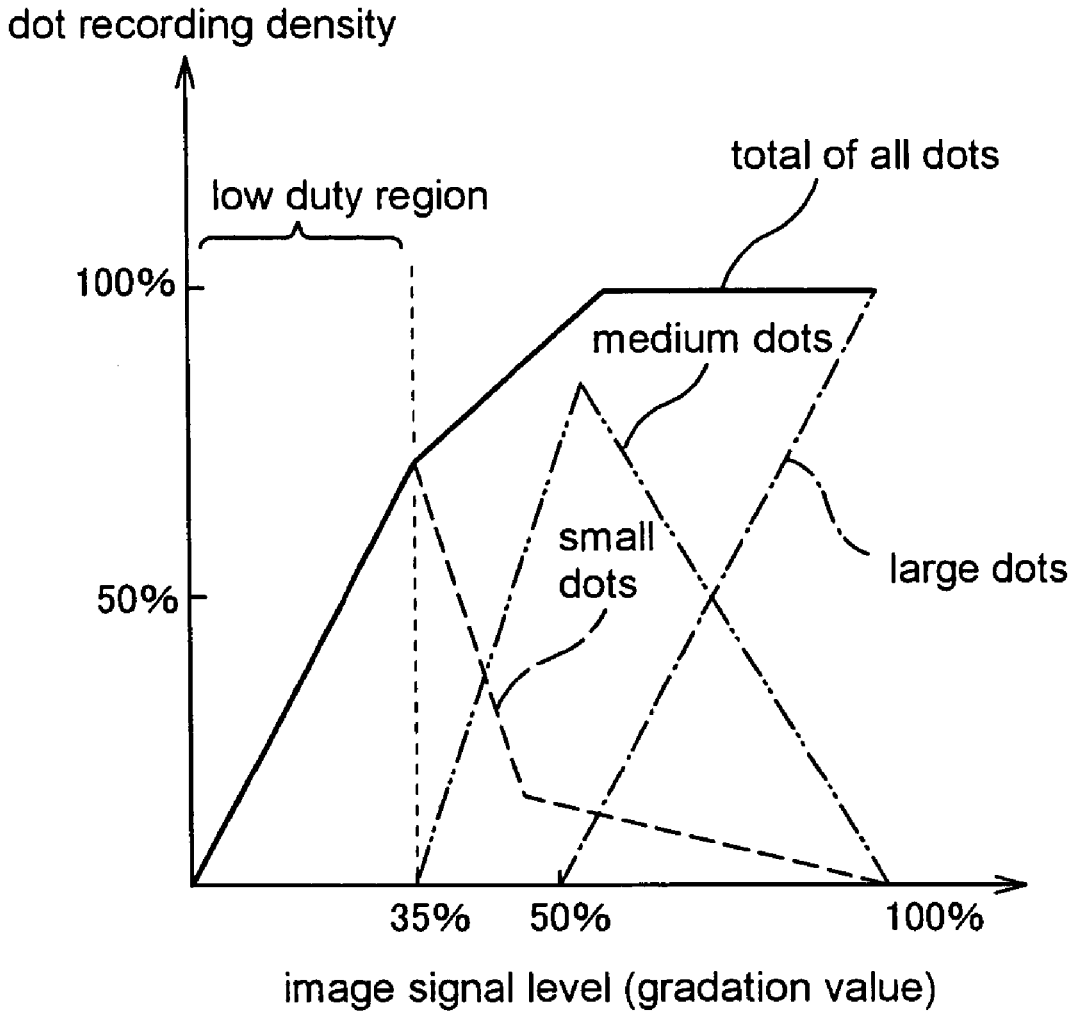
FIG. 8 is a diagram giving an explanation for the dots that form an image to be printed.

FIG. 8 is a diagram giving an explanation for the dots that form an image to be printed.

When a gradated image is to be printed, the image includes, for example, so-called highlight regions with low darkness, such as the human skin and the sky in a scenic shot, and so-called shadow regions with high darkness. This gradation is expressed by, for example, the so-called dot recording density (i.e., the area in which the dots occupy per unit area) and the color of ink that forms each dot. That is, the gradation is implemented by using ink of a predetermined color to dispersedly print dots of the above-mentioned three kinds (sizes) within a predetermined area. More specifically, as shown in FIG. 8, only the small dots are used in the low-darkness region (low duty region). As the darkness increases, medium dots start to be formed while the number of small dots decrease. In the region where the gradation value, which indicates the darkness, is 100%, printing is performed using large dots, each large dot being formed of a small dot and a medium dot. The gradation value, which indicates the darkness, is expressed, for example, by an O.D. value (darkness: Optical Density) obtained by measuring a measurement target portion with a colorimeter, with reference to the maximum value (set by each printer maker) of the O.D. value, i.e., where the dot recording density is 100%. Specifically, for example, an image whose dot recording density becomes 100% is printed with a printer using predetermined application software, the printed image is measured using a colorimeter such as an X-Rite938 (product name; manufactured by X-Rite), and the O.D. value obtained is set as the reference value for "dot recording density=100%". Then, the measurement target portion in an image is measured using the same calorimeter, X-Rite938 (product name), and the value obtained by comparing the O.D. value obtained for the measurement target portion with the above-mentioned reference value becomes the gradation value for that measurement target portion.

The above-mentioned highlight region is the region in FIG. 8 in which the gradation value is 35% or less and is the region in which printing is performed using only small dots. As for color images, the highlight region is printed using light-colored ink such as light cyan (LC), light magenta (LM), and yellow (Y). As for monochrome gradated images, the highlight region is printed using black ink or light black ink, which is not used in the present embodiment.

That is, the dots for printing the highlight region are dots that are formed in the region in which the gradation value is 35% or less. For example, when printing the highlight region with dots of a plurality of different darkness, light-colored ink—such as light cyan (LC), light magenta (LM), and yellow (Y)—other than the darkest ink is used for forming the dots. When there are a plurality of kinds of dot sizes, dots other than the largest-size dots are used for the highlight region. Particularly, dots formed using the lightest ink and/or dots of the smallest size are often formed in the highlight region.

EXAMPLE OF THE OVERALL CONFIGURATION OF PRINTING SYSTEM

Figure 10:
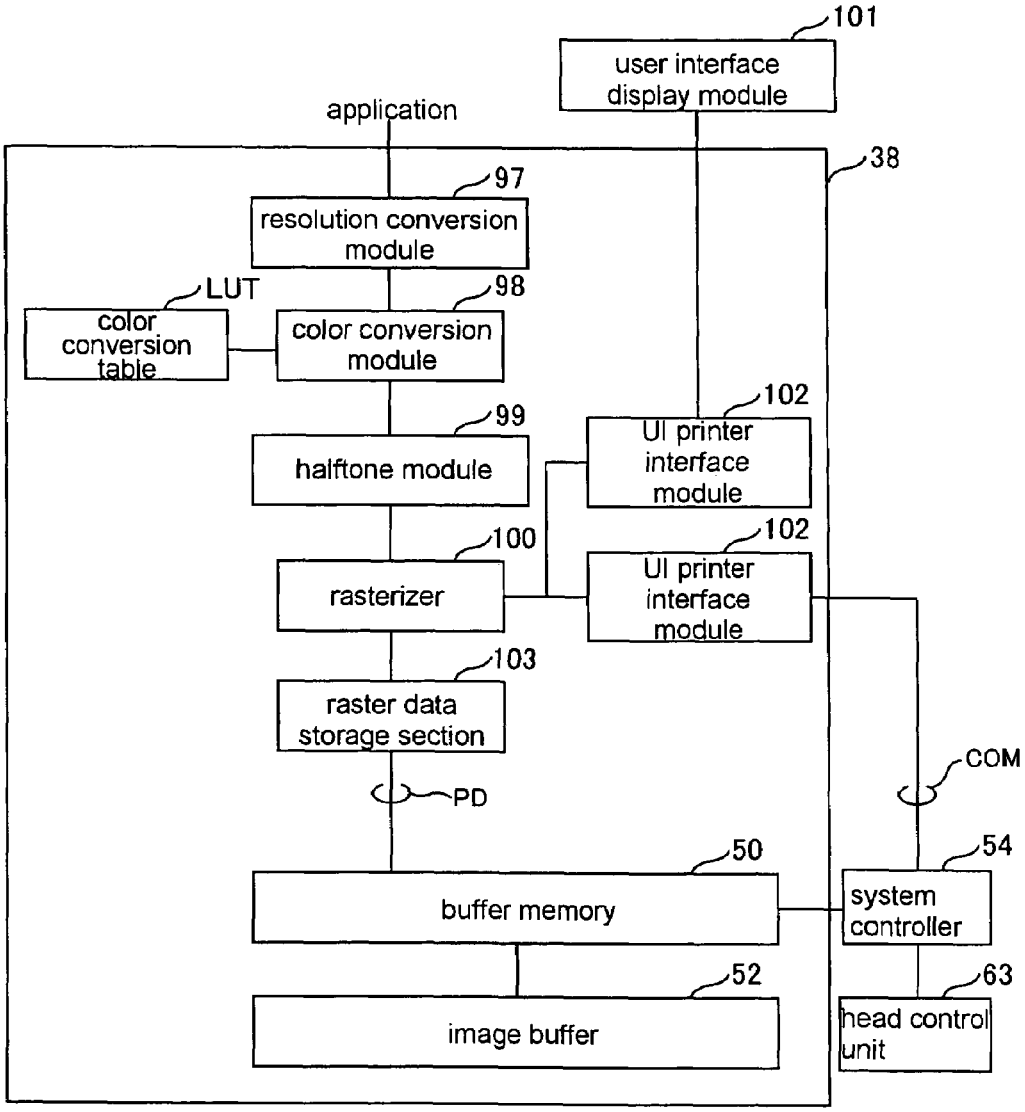
FIG. 10 is a block diagram showing the configuration of an image processing unit.

Next, an example of the overall configuration of a printing system is described with reference to FIG. 9 and FIG. 10. FIG. 9 is a block diagram showing the configuration of a printing system provided with the color printer 20 described above. FIG. 10 is a block diagram showing the configuration of an image processing unit 38.

The printing system is provided with a computer 90 and the color printer 20, which is an example of the printing apparatus. It should be noted that the printing system including the color printer 20 and the computer 90 can also be broadly referred to as a "printing apparatus." The system is made of the computer 90, the color printer 20, a CRT 21, and a display device (not shown) such as a liquid crystal display device, input devices (not shown) such as a keyboard and a mouse, and a drive device (not shown) such as a flexible disk drive device or a CD-ROM drive device.

In the computer 90, an application program 95 is executed under a predetermined operating system. The operating system includes a video driver 91, and the application program 95, which is for retouching images, for example, carries out desired processing with respect to an image to be processed, and also displays the image on the CRT 21 through the video driver 91.

The color printer 20 includes image processing units 38 which serve as information generating means, a system controller 54 for controlling the operations of the entire color printer 20, a main memory 56, and an EEPROM 58. Each image processing unit 38 receives print data and so forth from the application program 95. The system controller 54 is further connected to a main-scanning drive circuit 61 for driving the carriage motor 30, a sub-scanning drive circuit 62 for driving the carry motor 31, and head control units 63 serving as controlling means for controlling the print heads 36.

As shown in FIG. 1, FIG. 2, and FIG. 9, the color printer 20 described above includes a plurality of print heads 36. In the present embodiment, the number of print heads 36 is eight (8), and these eight print heads 36 are grouped into four print head groups 69 so that each of the print heads 36*c*, 36*d*, 36*e*, and 36*f* that are located on the side closer to the engaging section 46 between the carriage 28 and the pull belt 32 is paired with one of the print heads 36*a*, 36*b*, 36*g*, and 36*h* that are located on the side further from the engaging section 46. Each print head group 69 is arranged on the carriage 28 spaced from each other in the vertical and lateral directions.

That is, the color printer 20 includes a first print head group 69*a* (the group in the upper left in FIG. 1), a second print head group 69*b* (the group in the upper right in FIG. 1), a third print head group 69*c* (the group in the lower left in FIG. 1), and a fourth print head group 69*d* (the group in the lower right in FIG. 1). Further, as shown in FIG. 9, each print head group 69 forms a unitized print head unit 65, that is, a first print head unit 65*a*, a second print head unit 65*b*, a third print head unit 65*c*, and a fourth print head unit 65*d*, respectively. Each print head unit 65 is configured so that it is attachable to and detachable from the printer body.

Further, each print head unit 65 has an ink tank 67 for containing ink to be supplied to the print heads 36 in that print head unit 65. Of the paired print heads 36 of each print head group 69, the nozzles of the print head 36 that is located on the side closer to the engaging section 46 between the pull belt 32 and the carriage 28 are set to be able to eject ink in the entire image-print region. On the other hand, the nozzles of the print head 36 that is located on the side further from the engaging section 46 are set not to eject ink in the so-called highlight regions, i.e., the regions in the image-print region where the darkness is low.

Further, in the color printer 20, a head control unit 63 is provided for each print head group 69. That is, in the present embodiment, the first print head group 69*a* has a corresponding first head control unit 63*a*, the second print head group 69*b* has a corresponding second head control unit 63*b*, the third print head group 69*c* has a corresponding third head control unit 63*c*, and the fourth print head group 69*d* has a corresponding fourth head control unit 63*d*. Each head control unit 63 is individually unitized, and the unitized head control units 63 are configured so that they can be attached to and detached from the printer body.

In the same way, the image processing unit 38 described above is provided for each print head group 69. That is, in the present embodiment, the first print head group 69*a* has a corresponding first image processing unit 38*a*, the second print head group 69*b* has a corresponding second image processing unit 38*b*, the third print head group 69*c* has a corresponding third image processing unit 38*c*, and the fourth print head group 69*d* has a corresponding fourth image processing unit 38*d*. Each image processing unit 38 is individually unitized, and the unitized image processing units 38 are configured so that they can be attached to and detached from the printer body.

When the application program 95 issues a print command, the image processing unit 38 provided in the color printer 20 receives image data from the application program 95 and converts the data into print data PD. As shown in FIG. 10, the image processing unit 38 is internally provided with a resolution conversion module 97, a color conversion module 98, a halftone module 99, a rasterizer 100, a UI printer interface module 102, a raster data storage section 103, a color conversion lookup table LUT, a buffer memory 50, and an image buffer 52.

The resolution conversion module 97 serves to convert the resolution of the color image data generated by the application program 95 into a corresponding print resolution based on information about the print mode and so forth that has been received with the image data. The image data whose resolution has been thus converted at this point is still image information made of the three color components RGB. The color conversion module 98 references the color conversion look-up table LUT and, for each pixel, converts the RGB image data into multi-gradation data of a plurality of ink colors that can be used by the color printer 20.

The multi-gradation data that has been color converted has a gradation value of 256 grades, for example. The halftone module 99 executes so-called halftone processing to generate halftone image data. Here, for example, "halftoning" is done by dividing an image into regions each made up of a plurality of portions (a pixel can be formed in each of these portions), and expressing the darkness of each region by whether or not to form either a large dot, a medium dot, or a small dot in each of the portions that make up that region. Therefore, in the halftone image data, data for each pixel is expressed as binary data indicating the level of gradation of each pixel. The nozzles for printing each pixel is preset according to information about the print mode that is received with the image data from the application program 95. Therefore, the nozzles for printing the portions in which dots for the highlight region in the image are formed, that is, the portions for forming small dots using light ink, are set to be in the print heads 36*c*, 36*d*, 36*e*, and 36*f*, of each print head group 69*a*, 69*b*, 69*c*, and 69*d*, that are located on the side closer to the pull belt 32. Further, for example, the carry amount of print paper and the number of nozzles used during one scan movement of the carriage 28 are different between the high speed print mode, i.e., the so-called band-feed printing mode, and the high quality print mode, i.e., the so-called interlace mode. Therefore, the setting of the nozzles for forming the dots in the highlight region differs according to the print mode. Particularly, when printing according to the so-called overlap mode in which each dot line (raster line) formed in the main-scanning direction is printed by several scan movements of the carriage 28, it is preferable to set, as the nozzles for forming the dots in the highlight region, continuously-arranged nozzles n amounting to at most half of all of the nozzles n forming a row in the sub-scanning direction in each print head group. Specifically, for example, when printing a raster line with two scan movements of the carriage 28, continuously-arranged nozzles n amounting to half of all of the nozzles n in a print head group are set as the nozzles for forming the dots in the highlight region; when printing a raster line with four scan movements of the carriage 28, continuously-arranged nozzles n amounting to ¼ of all of the nozzles n in a print head group are set therefor. In this way, it becomes easy to generate print data and control the print heads in overlap-mode printing.

The halftone image data are arranged by the rasterizer 100 into a desired data order, and are output as the final print data PD to the raster data storage section 103. The signals for forming dots to print the highlight region of the image are assigned to the print heads 36 located on the side closer to the pull belt 32 described above.

On the other hand, the user interface display module 101 provided in the computer 90 functions to display various types of user interface windows related to printing and also functions to receive inputs from the user through these windows. For example, a user could instruct the type and size of the print paper, or the print mode, for example, through the user interface display module 101.

The UI printer interface module 102 functions as an interface between the user interface display module 101 and the color printer 20. The UI printer interface module 102 interprets instructions given by the user through the user interface and sends various commands COM to the system controller 54, for example, or conversely, it interprets commands COM received from the system controller 54, for example, and shows various displays on the user interface. For example, the above-mentioned instruction regarding the type or the size of the print paper, for example, that is received by the user interface display module 101 is sent to the UI printer interface module 102, which interprets this instruction and sends a command COM to the system controller 54.

The UI printer interface module 102 also functions as a print mode setting section. More specifically, the UI printer interface module 102 determines the print mode (or, recording mode) based on print information received by the user interface display module 101 such as information about the resolution of the image to be printed, information about the nozzles to use during printing, and information on data indicating the amount of carry in the sub-scanning direction. Then, the halftone module 99 and the rasterizer 100 generate print data PD corresponding to the print mode that has been determined, and the print data PD is sent to the raster data storage section 103. The print data PD sent to the raster data storage section 103 is temporarily stored in the buffer memory 50. Then, the data is converted into data corresponding to the nozzles and stored in the image buffer 52. Then, according to the information on the command COM output from the UI printer interface module 102, the system controller 54 of the color printer 20 controls the main-scanning drive circuit 61, the sub-scanning drive circuit 62, and the head control units 63 to actuate the nozzles for each color provided on each print head 36 for printing, based on the data in the image buffer 52. The print mode may include, for example, a high image quality mode for recording dots using the so-called interlace mode, and a high speed mode for recording dots without using the interlace mode.

Operation of The Printing System

The operations of the printing system will be described. First, the user sets roll paper of a predetermined size onto the holder and enters information about the print mode and so forth to the user interface display module 101. The user interface display module 101 may also be used to instruct different images to be printed by each print head group 69. Here, an example in which four different images are printed on the same sheet of roll paper set on the holder 27 by different ones of the four print head groups 69 according to the same print mode will be described to exemplify the printing operation of the present printing system.

That is, the printing system is instructed to print, on a sheet of print paper according to the same print mode, a first image using the print heads 36 belonging to the first print head group 69*a*, a second image using the print heads 36 belonging to the second print head group 69*b*, a third image using the print heads 36 belonging to the third print head group 69*c*, and a fourth image using the print heads 36 belonging to the fourth print head group 69*d*.

The instructions received by the user interface display module 101 is sent to the UI printer interface module 102 in each of the above-mentioned four image processing units 38*a*, 38*b*, 38*c*, and 38*d*. Each UI printer interface module 102 interprets these instructions and sends a command COM to the system controller 54.

Next, the user instructs printing through, for example, the application program 95. When the application program 95, which has received the print instruction, issues a print command, each of the four image processing units 38*a*, 38*b*, 38*c*, and 38*d* receives image data for each of the four images from the application program 95. After converting the image data into print data PD, the print data PD are sent to the buffer memory 50. Each of the image processing units 38*a*, 38*b*, 38*c*, and 38*d* receives the print data PD corresponding to each of the first, second, third, and fourth images with its buffer memory 50, and then sends the print data to its image buffer 52.

Further, each of the image processing units 38*a*, 38*b*, 38*c*, and 38*d* sends the above-described commands COM to the system controller 54. Then, according to the information received from each of the image processing units 38*a*, 38*b*, 38*c*, and 38*d*, the system controller 54 sends control signals to the main-scanning drive circuit 61, the sub-scanning drive circuit 62, and the above-mentioned four head control units 63*a*, 63*b*, 63*c*, and 63*d*.

Then, according to the control signals from the system controller 54, each of the head control units 63*a*, 63*b*, 63*c*, and 63*d* reads out print data for each color component from the image buffer 52 in the image processing unit 38*a*, 38*b*, 38*c*, and 38*d* corresponding to each head control unit 63*a*, 63*b*, 63*c*, and 63*d*. According to the read-out data, each of the head control units 63*a*, 63*b*, 63*c*, and 63*d* controls the print heads 36 belonging to the print head group 69*a*, 69*b*, 69*c*, and 69*d* corresponding to each head control unit 63*a*, 63*b*, 63*c*, and 63*d*.

Then, while controlling the carry motor 31 with the sub-scanning drive circuit 62 to feed the roll paper P, the system controller 54 controls the carriage motor 30 with the main-scanning drive circuit 61 to make the carriage 28 move in the main-scanning direction, and also makes the print heads 36 controlled by each of the head control units 63*a*, 63*b*, 63*c*, and 63*d* eject ink to print on the roll paper P.

More specifically, the print heads 36*a*, 36*b*, 36*g*, and 36*h* that are located on the side further from the engaging section 46 between the pull belt 32 and the carriage 28 form medium dots and large dots based on the print data read out from each image buffer 52, whereas the print heads 36*c*, 36*d*, 36*e*, and 36*f* that are located on the side closer to the engaging section 46 form medium dots, large dots, and small dots based on the print data, thereby printing the four images on the roll paper P.

That is, the nozzles n that eject ink for printing the highlight regions are provided in the print heads 36*c*, 36*d*, 36*e*, and 36*f* that are located on the side closer to the engaging section 46. The reason to this is as follows. During printing, the carriage 28 is pulled by the pull belt 32 to move. While the carriage 28 is moved, it is caused to vibrate or oscillate about the engaging section 46. The vibration or oscillation becomes larger as the distance from the engaging section becomes larger. This means that the precision with which dots are formed in their target positions decreases as the distance from the engaging section becomes larger. Therefore, the ink for printing the highlight regions is ejected from the nozzles n in the print heads 36*c*, 36*d*, 36*e*, and 36*f* that are located on the side closer to the engaging section 46 and that move while their vibration or oscillation is restricted by the engaging section 46 between the pull belt 32 and the carriage 28. In this way, since the vibrations and oscillations are small, it becomes possible to precisely form dots in their target dot-forming positions. Therefore, it becomes possible to improve the image quality of the highlight regions where images tend to become grainy and to print images having high quality. Further, since the dots for regions other than the highlight regions can be formed by all of the nozzles, it becomes possible to print at high speed using a larger number of nozzles.

In the present embodiment, the number of print heads is eight (8). However, this is not a limitation, and any number of print heads can be adopted. Further, it is not necessary to form print head groups.

Further, in the present embodiment, the engaging section 46 between the pull belt 32 and the carriage 28 is located approximately at the center of the carriage 28. However, the position of the engaging section 46 is not limited to the above. For example, the pull belt 32 may be located below all of the eight print heads 36 on the carriage 28. In this case, the small dots for the highlight regions are printed using the print heads 36*c* through 36*h*, that is, the print heads 36 except for the two print heads 36*a* and 36*b* that are located on the uppermost side. In this way, since the small dots will not be formed by the print heads 36*a* and 36*b* that are located furthest from the engaging section, it becomes possible to print the dots for the highlight regions with high positional precision and thereby improve image quality. Further, by using the print heads belonging only to the four lower-side print heads 36*e*, 36*f*, 36*g*, and 36*h*, or only the two lower-side print heads 36*g* and 36*h*, for forming the small dots, it becomes possible to print images with higher quality.

Furthermore, the printer may only have one print head. In this case, it becomes possible print high-quality images by forming the small dots with nozzles, among the plurality of nozzles in the print head, that are located on the side closer to the engaging section between the carriage and the pull belt.

Also, in the above description, the image processing unit shown in FIG. 10 was used as an example of image processing means; however, this is not a limitation, and any means may be adopted, as long as it processes images output by an application, for example, in order to carry out operations such as to send print data to the head control unit 63. For example, it is not necessary for the color conversion table to always be referenced when the color conversion module 98 performs color conversion, and it is also possible for the image processing means to not include a function as a user interface, such as the UI printer interface module 102.

OTHER EMBODIMENTS

Above, a recording apparatus and so forth according to the present invention was described according to an embodiment thereof. However, the above-mentioned embodiment of the invention has been merely given for facilitating understanding of the present invention, and is not to limit the scope of the present invention. It is without saying that the present invention may be altered and/or modified without departing from the scope thereof, and that the present invention includes its equivalents.

Above, a color inkjet printer that prints using ink was described as an example of a printing apparatus. However, the present invention is applicable to monochrome inkjet printers as well.

Further, roll paper was described as an example of print paper. However, it is possible to use A0 size or B0 size paper as well.

Further, in the present embodiment, each print head group configured a unitized print head unit, and each print head unit was attachable to and detachable from the printer body. However, this is not a limitation.

Further, when processing different images with each of the image processing units in the present embodiment, the image processed by each image processing unit was printed onto the roll paper in the order the processing was finished, by ejecting ink from the print heads belonging to the print head group corresponding to the image processing unit. However, this is not a limitation. For example, the images may start being printed onto the roll paper P after processing for all of the images has finished.

What is claimed is:

1. A printing apparatus comprising:

a plurality of ink ejecting sections for ejecting ink; and a carriage that is movable and that holds said ink ejecting sections, wherein said printing apparatus prints an image on a medium to be printed by ejecting ink from said ink ejecting sections;

wherein said ink ejecting sections comprise:

a first ink ejecting section that is set to eject ink for printing a predetermined region in said image, a darkness of said predetermined region being lower than a predetermined value, and a second ink ejecting section that is set not to eject the ink for printing said predetermined region in said image, and wherein said second ink ejecting section is subject to a greater vibration that is generated by a movement of said carriage than said first ink ejecting section.

2. A printing apparatus according to claim 1, wherein:

said image is printed with dots that are in at least two sizes and that are formed with the ink ejected from said ink ejecting sections; and among said dots that are in said at least two sizes, dots that are formed for printing said predetermined region with the ink ejected from said first ink ejecting section are dots other than dots of the largest size.

3. A printing apparatus according to claim 2, wherein:

among said dots other than the dots of the largest size, the dots that are formed for printing said predetermined region with the ink ejected from said first ink ejecting section are dots of the smallest size.

4. A printing apparatus according to claim 1, wherein:

said image is printed with at least two kinds of dots formed using a plurality of kinds of inks that differ in darkness and that are ejected from said ink ejecting sections; and among said at least two kinds of dots, dots that are formed for printing said predetermined region with the ink ejected from said first ink ejecting section are dots formed using ink other than the darkest ink.

5. A printing apparatus according to claim 4, wherein:

among said dots formed using ink other than the darkest ink, the dots that are formed for printing said predetermined region with the ink ejected from said first ink ejecting section are dots formed using the lightest ink.

6. A printing apparatus according to claim 4, wherein:

said inks that differ in darkness include cyan ink, light cyan ink that is lighter than said cyan ink, magenta ink, and light magenta ink that is lighter than said magenta ink; and the dots that are formed for printing said predetermined region with the ink ejected from said first ink ejecting section are dots formed using said light cyan ink and said light magenta ink.

7. A printing apparatus according to claim 1, wherein:

when assuming that a darkness level of the darkest region in said image is 100%, the darkness level of said predetermined region is at most 35%.

8. A printing apparatus according to claim 1, wherein:

said printing apparatus flirt her comprises a moving member that engages said carriage and that is for causing said carriage to move;

said dots are formed by ejecting ink from said ink ejecting sections while causing said carriage to move using said moving member; and said first ink ejecting section is an ink ejecting section, among said ink ejecting sections, that is located on the side closer to an engaging section where said carriage and said moving member engage.

9. A printing apparatus according to claim 8, wherein:

said ink ejecting sections are grouped into at least two groups;

each group of said ink ejecting sections forms an ink ejecting unit; and said ink ejecting section that is located on the side closer to said engaging section is an ink ejecting section that is included in an ink ejecting unit that is located on the side closer to said engaging section.

10. A printing apparatus according to claim 9, wherein:

all of said ink ejecting sections are allowed to eject ink for printing regions other than said predetermined region.

11. A printing apparatus according to claim 1, wherein:

the setting for said ink ejecting sections is changed according to print modes.

12. A printing apparatus according to claim 1, wherein:

said medium to be printed is printed on while being carried in a predetermined direction;

said ink ejecting sections are arranged in a row in the direction in which said medium to be printed is carried to form a row of ink ejecting sections; and said first ink ejecting section is at most half of continuously-arranged ink ejecting sections among all ink ejecting sections belonging to said row of ink ejecting sections.

13. A printing apparatus comprising:

a plurality of ink ejecting sections for ejecting ink; and a carriage that is movable and that holds said ink ejecting sections, wherein:

said printing apparatus prints an image on a medium to be printed by ejecting ink from said ink ejecting sections;

said ink ejecting sections comprise:

a first ink ejecting section that is set to eject ink for printing a predetermined region in said image, said predetermined region being a region in which, when assuming that a darkness level of the darkest region in said image is 100%, the darkness level of said predetermined region is at most 35%, and a second ink ejecting section that is set not to eject the ink for printing said predetermined region in said image;

said second ink ejecting section is subject to a greater vibration that is generated by a movement of said carriage than said first ink ejecting section;

all of said ink ejecting sections are allowed to eject ink for printing regions other than said predetermined region;

the setting for said ink ejecting sections is changed according to print modes;

said image is printed with at least two kinds of dots that are formed with the ink ejected from said ink ejecting sections and that are formed by dots that are in at least two sizes and that are formed with the ink ejected from said ink ejecting sections, and by using cyan ink, light cyan ink that is lighter than said cyan ink, magenta ink, and light magenta ink that is lighter than said magenta ink, which differ in darkness;

the dots that are formed for printing said predetermined region with the ink ejected from said first ink ejecting section are either dots of the smallest size among said dots that are in at least two sizes, or dots formed using said light cyan ink and said light magenta ink;

said printing apparatus flirt her comprises:

a moving member that engages said carriage and that is for causing said carriage to move;

said ink ejecting sections are grouped into at least two groups;

each group of said ink ejecting sections forms an ink ejecting unit;

said dots are formed by ejecting ink from said ink ejecting sections while causing said carriage to move using said moving member;

said first ink ejecting section is an ink ejecting section, among said ink ejecting sections, that is included in an ink ejecting unit located on the side closer to an engaging section where said carriage and said moving member engage;

said medium to be printed is printed on while being carried in a predetermined direction;

said ink ejecting sections are arranged in a row in the direction in which said medium to be printed is carried to form a row of ink ejecting sections; and said first ink ejecting section is at most half of continuously-arranged ink ejecting sections among all ink ejecting sections belonging to said row of ink ejecting sections.

14. A computer-readable storage medium having recorded thereon a program for causing a printing apparatus comprising a plurality of ink ejecting sections for ejecting ink; and a carriage that is movable and that holds said ink ejecting section, wherein said printing apparatus prints an image on a medium to be printed by ejecting ink from said ink ejecting sections;

wherein said ink ejecting sections comprise:

a first ink ejecting section that is set to eject ink for printing a predetermined region in said image, a darkness of said predetermined region being lower than a predetermined value, and a second ink ejecting section that is set not to eject the ink for printing said predetermined region in said image;

to print said predetermined region by making said first ink ejecting section eject ink, and wherein said second ink ejecting section is subject to a greater vibration that is generated by a movement of said carriage than said fist ink ejecting section.

15. A computer system comprising:

a computer; and a printing apparatus that is connected to said computer and that includes a plurality of ink ejecting sections for ejecting ink and a carriage that is movable and that holds said ink ejecting sections, wherein said printing apparatus prints an image on a medium to be printed by ejecting ink from said ink ejecting sections;

wherein said ink ejecting sections comprise:

a first ink ejecting section that is set to eject ink for printing a predetermined region in said image, a darkness of said predetermined region being lower than a predetermined value, and a second ink ejecting section that is set not to eject the ink for printing said predetermined region in said image; and wherein said second ink ejecting section is subject to a greater vibration that is generated by a movement of said carriage than said first ink ejecting section.

16. A printing apparatus comprising:

a plurality of print heads for ejecting ink, each of said print heads having at least a black nozzle row, cyan nozzle row, magenta nozzle row and yellow nozzle row; and a carriage that is movable and that holds said print heads, wherein said printing apparatus prints an image on a medium to be printed by ejecting ink from said print heads;

wherein said print heads comprise:

a first print head that is set to eject ink for printing a predetermined region in said image, a darkness of said predetermined region being lower than a predetermined value, and, and a second print head that is set not to eject the ink for printing said predetermined region in said image; and wherein said second print head is subject to a greater vibration that is generated by a movement of said carriage than said first print head.

* * * * *